United States Patent [19]

Flämig

[11] Patent Number: 4,549,413

[45] Date of Patent: Oct. 29, 1985

[54] DEVICE FOR THE PHOTOELECTRIC SUPERVISION OF A WARP LOOM

[75] Inventor: Peter Flämig, Munich, Fed. Rep. of Germany

[73] Assignee: Protechna Herbst GmbH & Co. KG, Ottobrunn, Fed. Rep. of Germany

[21] Appl. No.: 653,948

[22] Filed: Sep. 21, 1984

[30] Foreign Application Priority Data

Sep. 30, 1983 [DE] Fed. Rep. of Germany ..... 3335656

[51] Int. Cl.[4] ..... D04B 35/12

[52] U.S. Cl. ..... 66/163; 250/206; 250/559

[58] Field of Search ..... 66/157, 158, 163; 250/206, 559, 562

[56] References Cited

U.S. PATENT DOCUMENTS

| | | | |
|---|---|---|---|
| 3,401,267 | 9/1968 | Engle et al. | 66/163 X |
| 3,530,690 | 9/1970 | Nickell et al. | 66/163 |
| 3,575,515 | 4/1971 | Fertig | 66/163 X |
| 3,738,124 | 6/1973 | Reynolds | 66/163 |
| 4,267,554 | 5/1981 | Loepfe et al. | 66/163 X |

FOREIGN PATENT DOCUMENTS

| | | | |
|---|---|---|---|
| 2034815 | 1/1972 | Fed. Rep. of Germany | 66/163 |
| 3028476 | 2/1982 | Fed. Rep. of Germany | 66/163 |

*Primary Examiner*—Ronald Feldbaum

*Attorney, Agent, or Firm*—Bernard, Rothwell & Brown

[57] ABSTRACT

A device for the photoelectric supervision of a warp loom for irregularities in the yarn supply of a yarn sheet has an infrared radiation source and receiver, which are arranged so that the infrared beam is alternately interrupted and released, in time with the frequency of the oscillating eye needles, by the needles as well as by the yarns passing therethrough. This periodic supervisory signal sequence is periodically processed by a gating circuit only during a preset gating time period ($T_X$) within each beam release phase ($T_p$). The signal values issued in each window pulse gating phase are compared in a comparator circuit with a comparison value. If the latter is not attained, a control signal is generated for the warp loom.

26 Claims, 13 Drawing Figures

DEVICE FOR THE PHOTOELECTRIC SUPERVISION OF A WARP LOOM

This invention relates to a device for photoelectric monitoring of a warp loom for irregularities in the yarn supply of a yarn sheet, comprising a radiation source, whose beam extends in a plane parallel to said yarn sheet in the area of the yarn supply to the eye needles, a radiation receiver which generates a signal depending on the intensity of said radiation source an evaluation circuit which can be influenced by the signal and a display means for responding to a control signal characterising irregularity of said yarn supply and/or a switch device for driving said warp machine.

Such a device is known from German Pat. No. 30 28 476, in which a laser beam is used as the radiation beam, which is guided on the front yarn sheet directly in the area of the yarn supply or along the eye needles. Thus, the laser beam is projected along an area which in the take-off direction of the knitwear is directly adjacent to the area between the knitting surfaces of the bars and the holes of the front eye needle row occupying a forward relative position. Using this known device, errors in the knitwear are to be detected, in which broken and half-broken yarns have been fed in front of or between the guide bars and then retied into the knitwear. In this known device it is certainly possible that the wrongly tied-in yarns in the knitwear may cross the laser beam path when the knitwear emerges from the area of the warp elements. However a disadvantage of the known device is that such errors, if found at all, are discovered too late. It is also a disadvantage that e.g. broken yarns do not inevitably enter the laser beam path. Another disadvantage is that when using laser beams, dust particles may also cross the laser beam path and thus lead to a weakening of the base, while on additional evaluation circuit cannot under certain circumstances detect whether such weakening is due to a yarn break or to some other cause.

One object of the invention is therefore to provide a device of the type named above wherein, while avoiding the drawbacks of the known device, broken yarns or projecting capillaries or slubs of a yarn can be duly and reliably detected. Furthermore, errors are to be found in the case of those threadings, e.g. Atlas threadings, in which the yarns do not emerge loosely and/or emerge incompletely or partially from the yarn sheet. These yarns, normally grasped by an adjacent needle, and then wrought in, which otherwise would pass though in an uncontrolled manner and would lead to longer defects, are also to be determined by the device according to the invention.

The object is achieved according to the invention in that the source of radiation is provided as an infrared emitter, in that its beam is alternately at least partially interrupted and released, in synchronism with the oscillatory movement of the knitting tools or guide bars, by said knitting tools as well as by the yarns processed by them in the reversing positions of said tools, in that the periodic monitoring signal sequence of the infrared receiver thereby generated is periodically processed by the evaluation circuit by a window or gating circuit only during a preset gating time period within each beam release phase, so that only the signal values of the signal sequence generated in each window pulse-gating phase are compared in a comparator circuit with a comparison value. The preferred knitting tools here are eye needles or slide needles.

This has the advantage that the entire yarn sheet of the eye needles or the slide needles together with the yarns passing through their eyes is used periodically to interrupt and release the infrared beam.

As a rule, yarn breaks or capillary breaks occur mainly on the eye needles themselves. Because of their inertia effect, loose or broken yarns oscillate with some displacement of phase against the eye needles, especially in the reversing positions of the eye needles (when changing direction). Thus if the beam path is opened by the eye needles, a loose or broken yarn weakens the now open beam path with phase displacement and can therefore be evaluated. With capillary breaks and slub formation in the area of the eyes of the eye needles, there is also certainly a manifestation of this defect after the release of the beam path. Thus advantageously, due to the fact that the beam is arranged within the oscillation area of the eye needle as well as in the area of the eyes, the certainty of error recognition is substantially increased. Owing to the fact that the eye needles serve as the pulse emitter for the generation of a periodic signal sequence, the further advantage emerges of synchronisation of the signals with the eye needle movement, whereby the device according to the invention is especially simplified.

A further advantage is the fact that, because of this synchronisation, it is possible to have a window or gating circuit which functions reliably and which enables periodic processing of the signals within each beam release phase. Using this window and gate circuit therefore, the evaluation time can be periodically adjusted, within which a possible error is determined. The respective time periods between the gating phases are not considered, with the advantage that the reliability of the entire device is improved. Thus the device only interacts effectively with the comparator circuit when the beam is released. If the comparison value is not attained by the signal of the signal sequence within the gating period, circuit devices provided either in the display device or in the switch device switch off the drive of the warp loom.

Further advantageous embodiments of the invention are to be found in the sub-claims. The use of a timed memory or a timed memory circuit has the further advantage that the comparison of the signals is also possible within the gating pauses of the signal sequence. Another advantage is the fact that in this way d.c. step functions can be formed which can be better compared with comparative d.c. voltages when using analog circuit technology. Using such memory circuits has a further advantage in that they can also be used at high machine speeds of several thousand rpm. The memory devices ensure in particular that during the erasure and storage phase, a bridging signal is generated which corresponds to the signal before the erasure. The electronic gating, or window circuit accordingly prevents signal processing during the complete masking and/or beam interruption.

The use of a counter between the switch device of the warp loom and the comparator circuit is especially advantageous when it is necessary to prevent every yarn fluctuation from leading to switch off. Even in the normal operation of a textile knitting machine, the yarns briefly lose their tension. If they then enter into the monitoring beam path they would then lead to switch off without an actual defect being present. Now a counter registers the number of defects in a preset time interval, of e.g. from 1 to 2 seconds. Thus if the same error occurs in the new period, the counter content will be attained within the preset time period. The pulse then appearing at its transmission output then causes the stoppage of the warp loom. In this way a high degree of operating safety is achieved.

Therefore the device according to the invention makes possible a rational and almost 100% yarn break control, especially for cotton processing machines.

Upon electronic gating at every total masking of the infrared beam by the knitting tools, a ramp generator is started with the falling flank of an insensitive comparator, and this generator is again stopped by the rising flank of the following total masking pulse. The maximal voltage of the ramp is a measure of the respective spacing between two adjacent total maskings. Thus the maximal voltage is a measure of the speed of the knitting machine. The maximal ram d.c. voltage is stored until the next ramp. By the division of the ram into three, a first and second threshold value or voltage on the linearly rising ramp voltage is obtained. A certain time is allocated to the respective threshold ramp voltage. By displacement of the two ram voltages, the two associated time values can be displaced within the total ramp time. In this way, the gating time can be precisely adjusted. Thus the release or gating time for the evaluation of the beam can be adjusted to any length and correspondingly between the adjacent periodically returning total maskings. The increase of the ramp voltage can be adjusted depending on the rpm in order thereby to achieve for various machine types an rpm-dependent adjustment for the favorable working range of the ramp.

When using a display device, especially a monitor or a diode display, the gating can be exactly adjusted by visual examination. Advantageously, the timing frequency of the infrared transmission and receiver pulses is large in comparison with the timing frequency of the knitting tools.

The invention will be described below on the basis of the exemplary embodiments in FIGS. 1 to 9, in which:

FIG. 1 shows a schematic perspective view;

FIG. 1*a* shows a pulse sequence between two maskings with incorporated infrared receiver signals;

Figure 5:
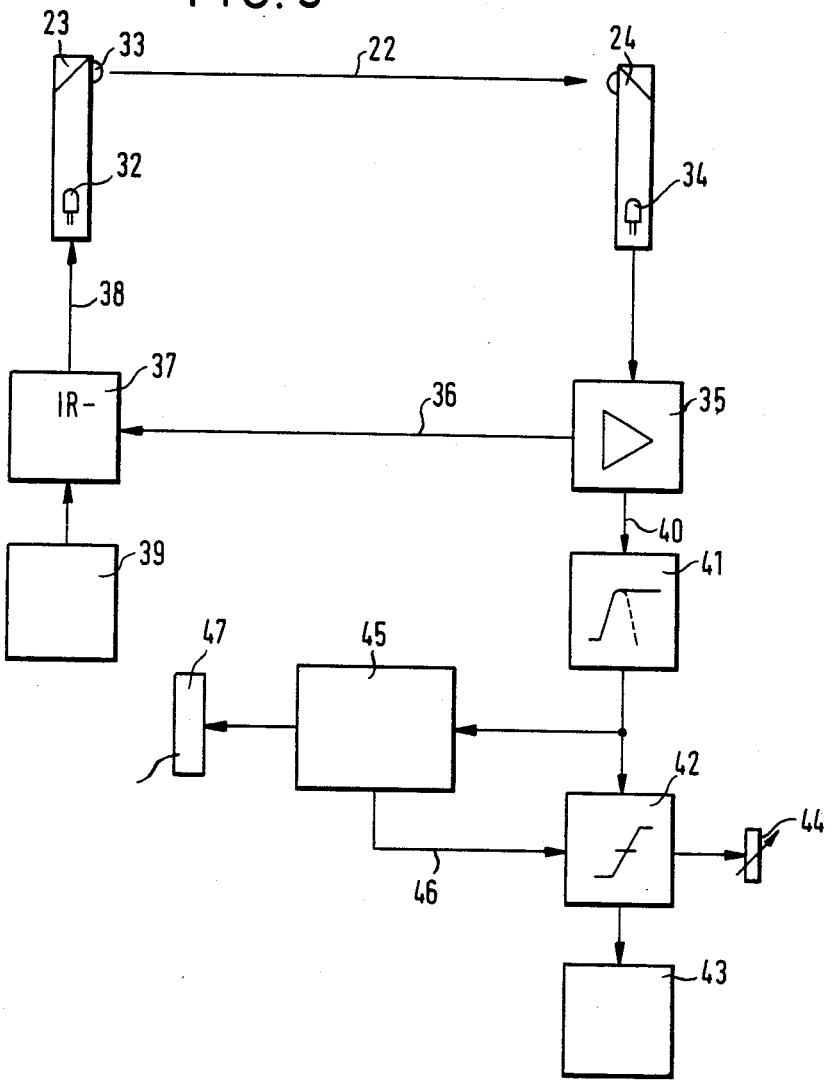
FIG. 5 shows a circuit diagram of an evaluation circuit.
Figure 5A:
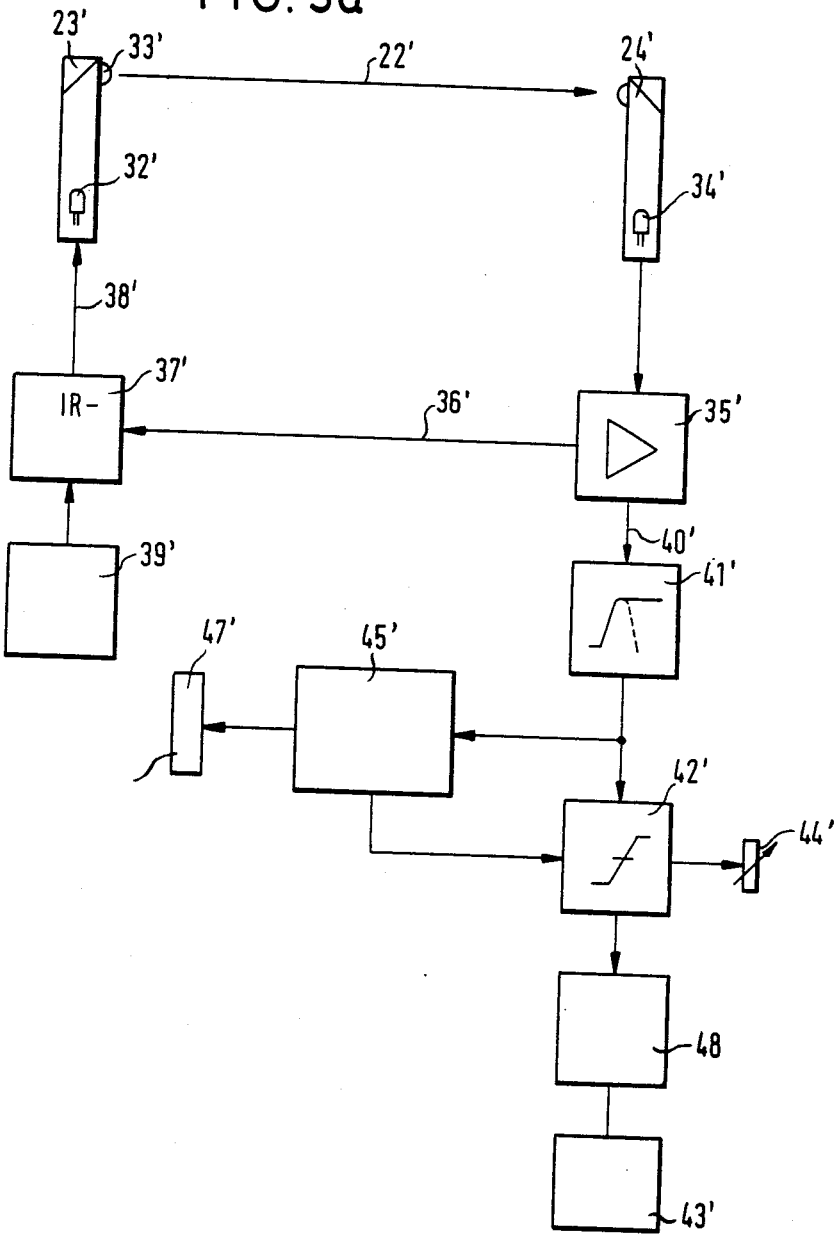
Figure 6:
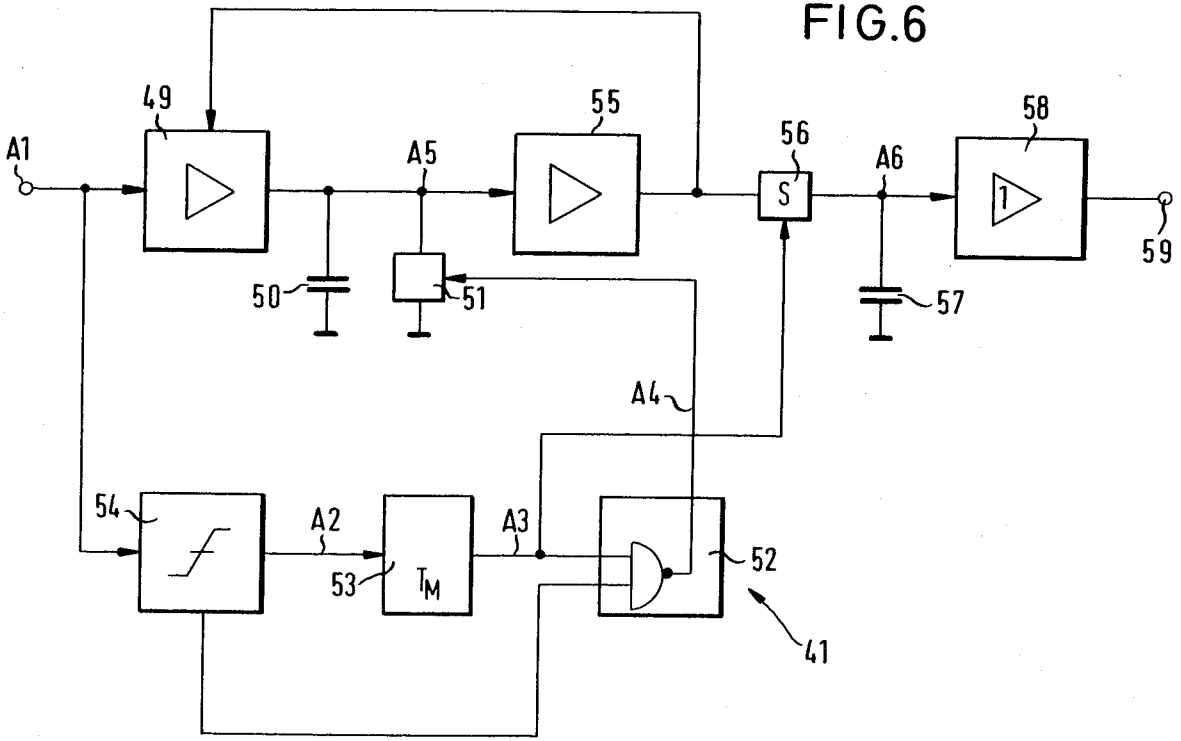
Figure 6A:
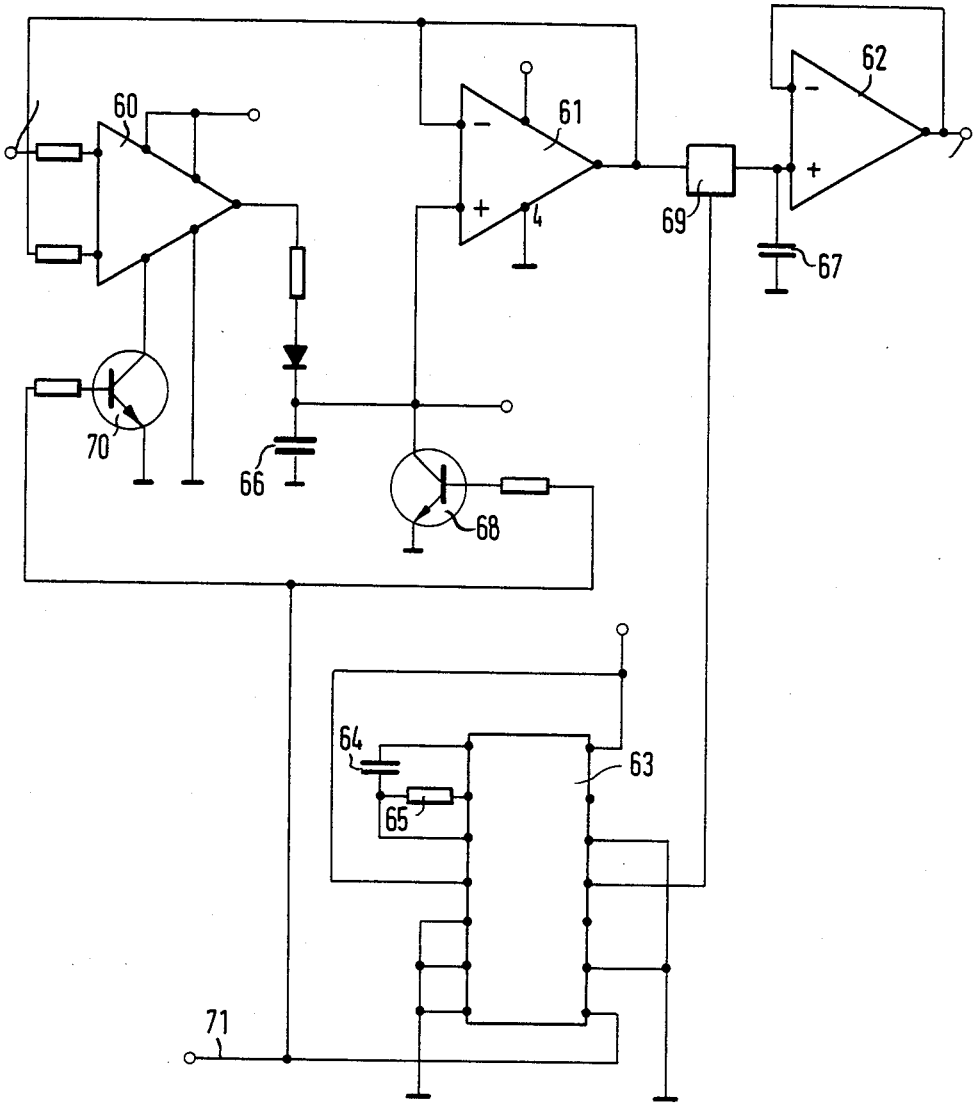
Figure 7:
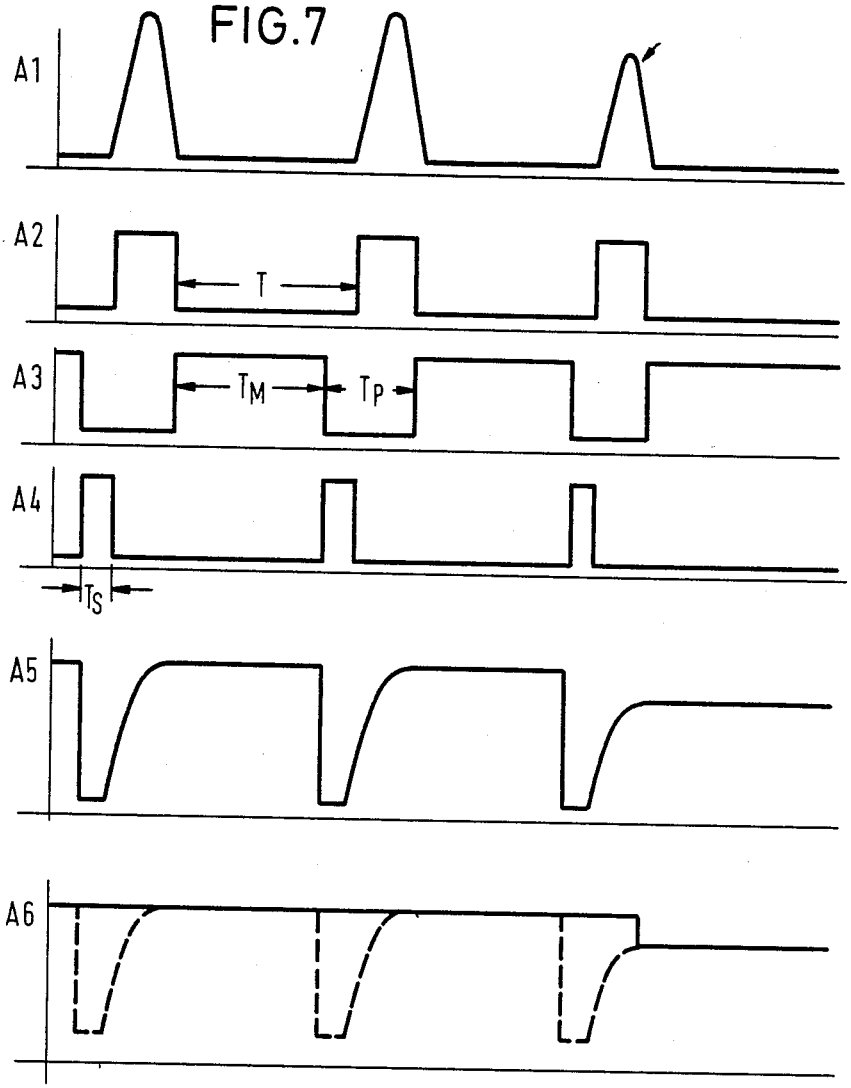
Figure 7A:
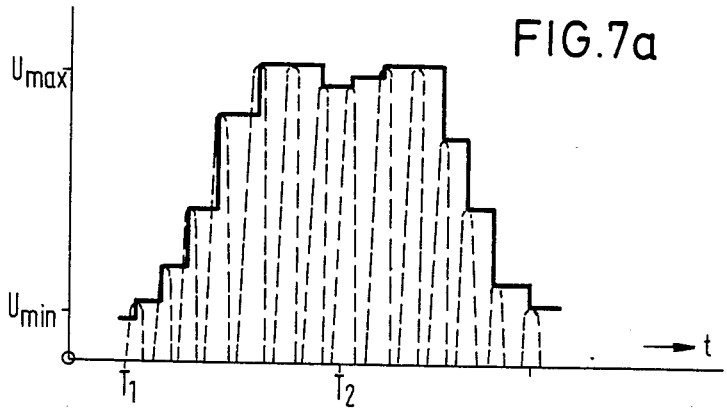
Figure 8:
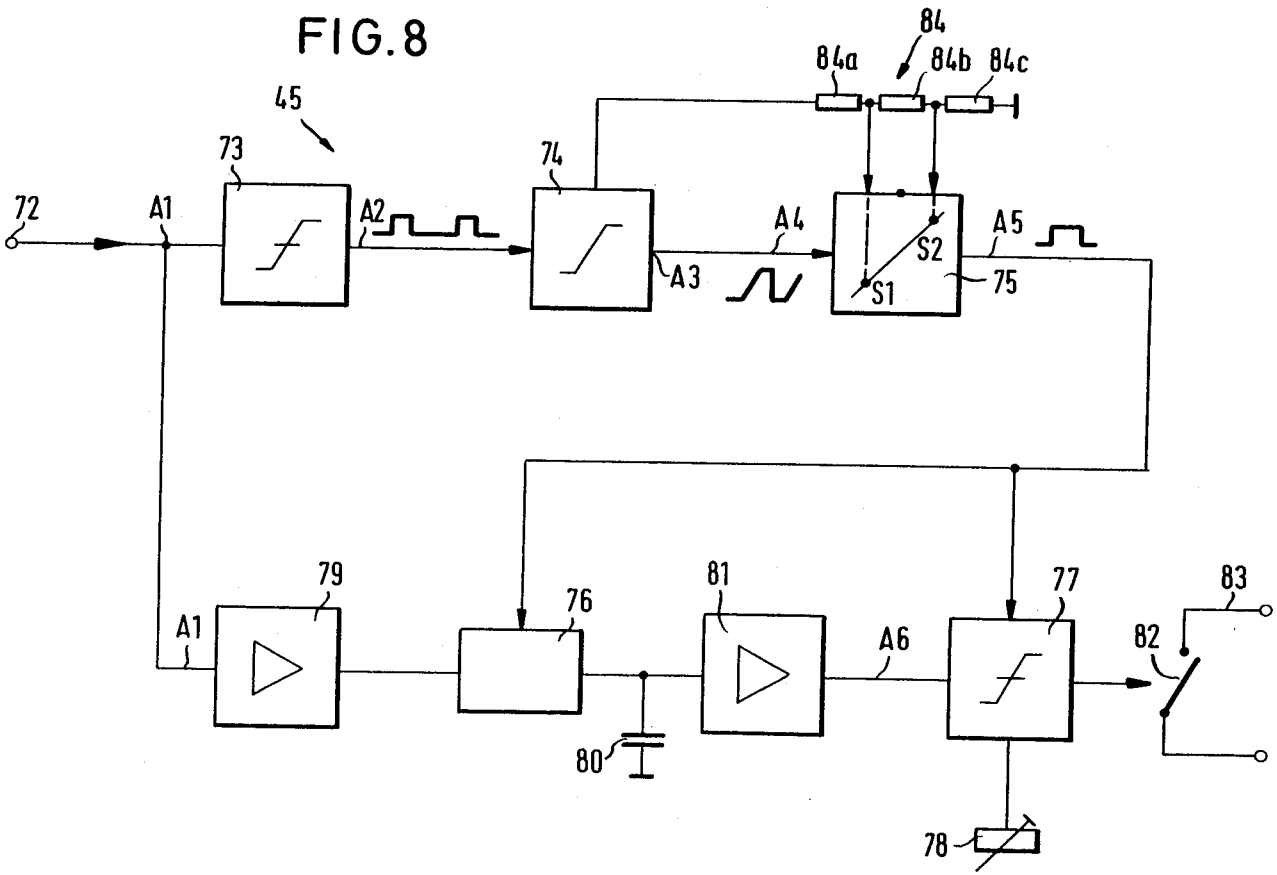

FIG. 5*a* shows a further embodiment;

FIG. 6 shows a memory device;

FIG. 6*a* shows another embodiment for a memory device;

FIG. 7 shows the pulse sequence for various circuit points of the circuit of FIG. 6; FIG. 7*a* shows the pulse sequence of the envelope formed by the curve A6 of FIG. 6;

FIG. 8 shows an electronic gating and/or window circuit; and

Figure 9:
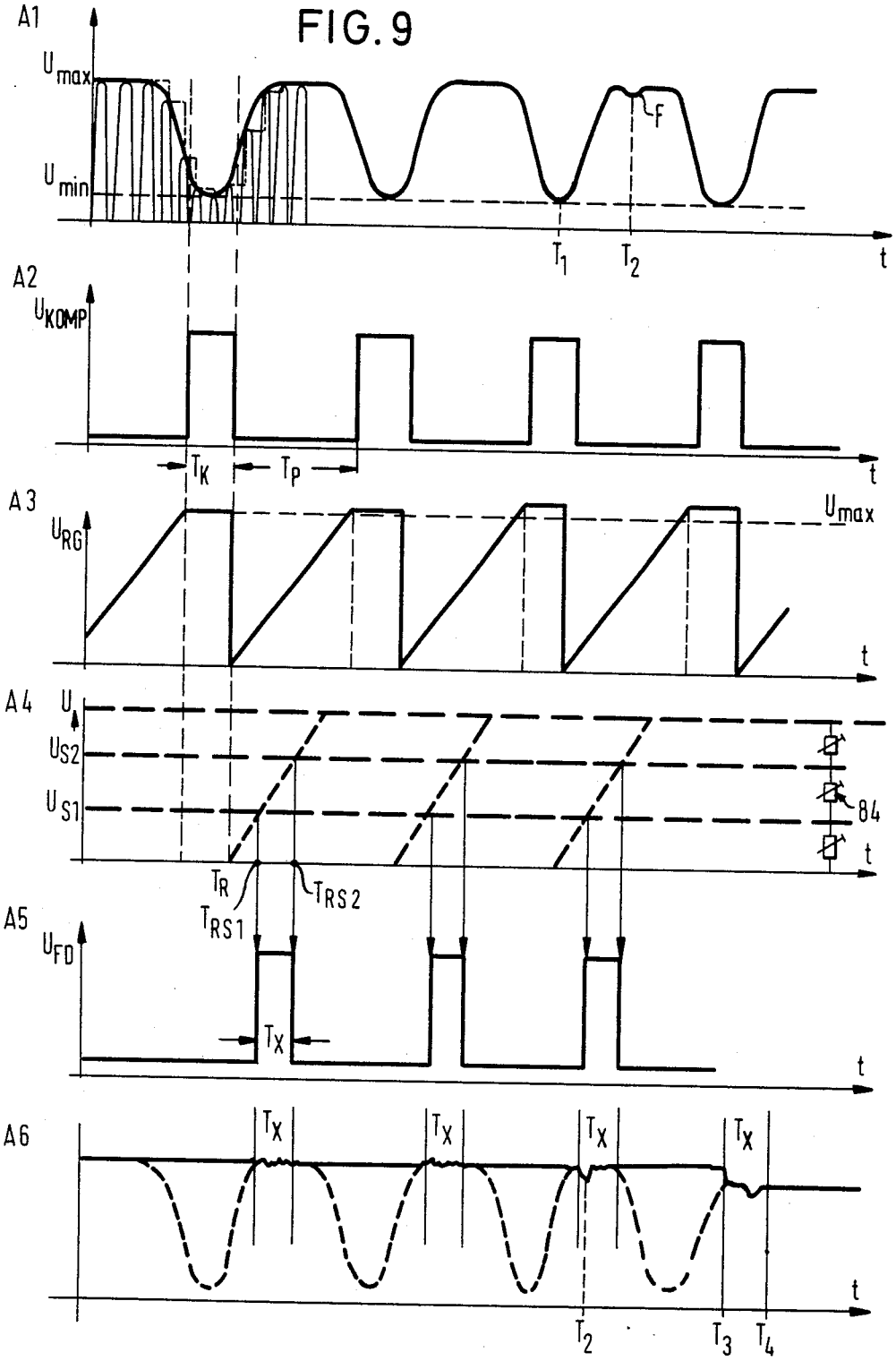

FIG. 9 shows the pulse sequence for various contact points of the circuit of FIG. 8.

1, 2, 3, 4 and 5 designate warp yarns which are led to the knitting elements via warp beams (not shown) over tension bars. 6, 7, 8, 9 and 10 designate eye needles which are provided with eyes 11, 12, 13, 14 and 15. 16, 17, 18, 19 and 20 designate bars. 21 shows a knitted fabric. Viewed from this fabric 21, there is located behind the yarn sheets 1 to 5 and parallel to the plane passing through said yarn sheet, an infrared beam 22, which is emitted by an infrared beam source 23 and is received by an infrared ray receiver 24. The infrared source 23 as well as the receiver 24 are arranged so that the beam 22 is periodically interrupted and released by the eye needles 6 to 10 as they swing back and forth.

Figure 1:
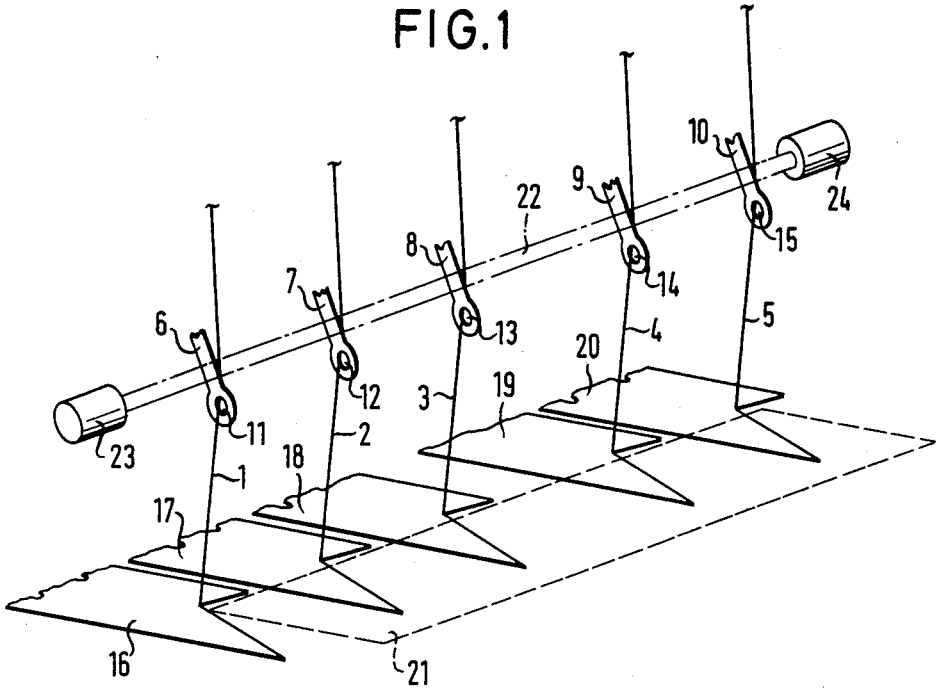
Figure 2:
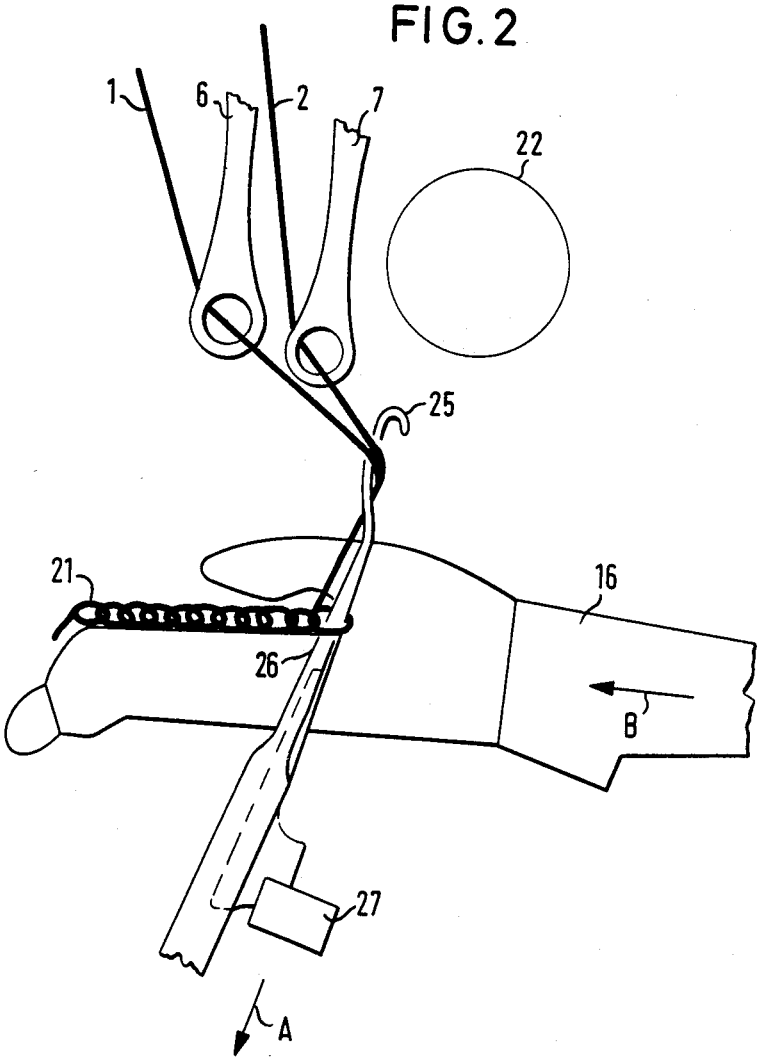
FIGS. 2–4 show a partial view across the beam with the relevant knitting tools.
Figure 3:
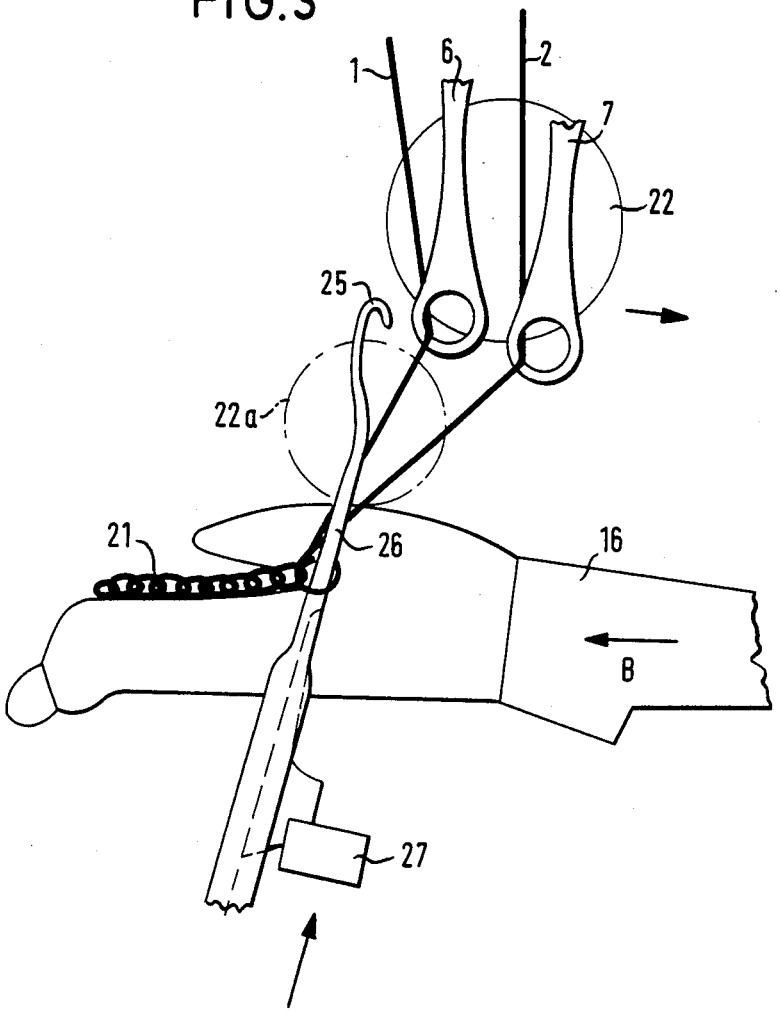
Figure 4:
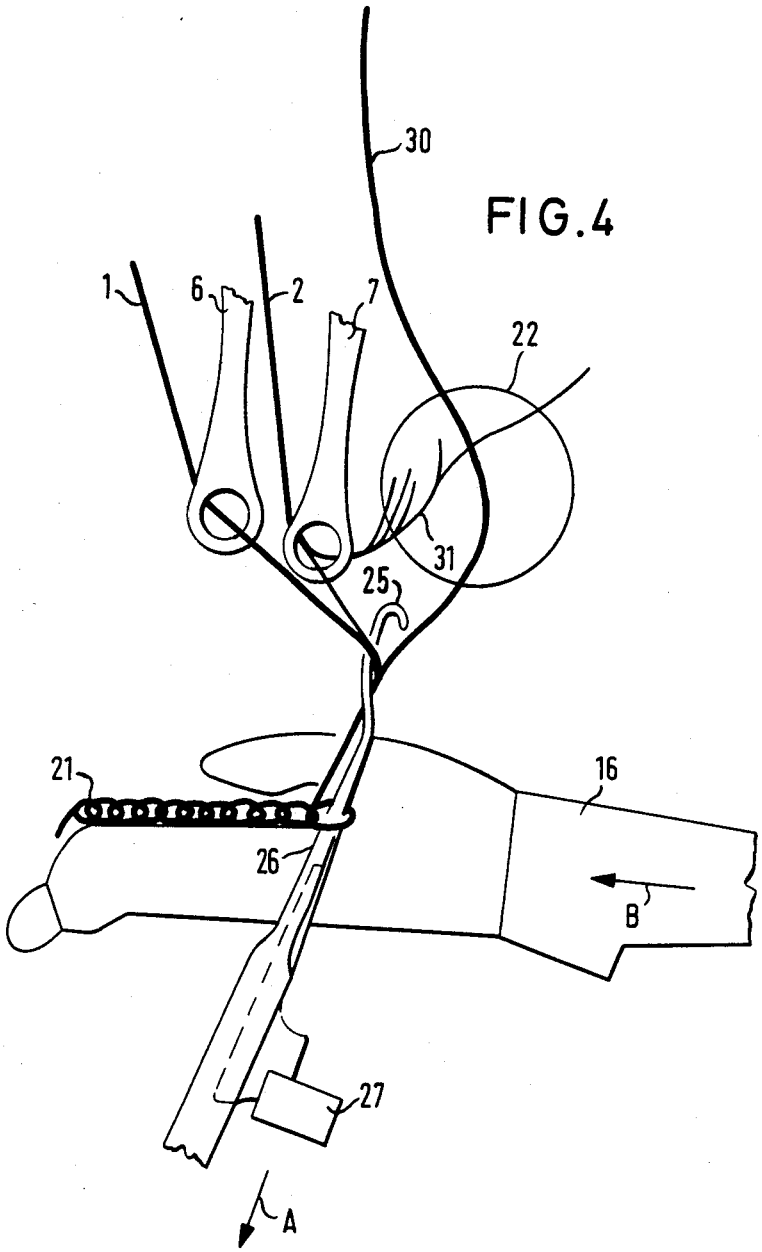

The parts shown in FIGS. 2 to 4 have the same reference numerals as the corresponding parts in FIG. 1.

The beam path 22 of the infrared beam is released by the eye needles and the knit yarns. In this position (240° position) the warp yarns are tucked. The guide bars and the eye needles swing forward. The yarns are inserted in the hooks 25 of the slide needles 26 which move downwards in the direction of arrow A. The slides 27 remain in their upper position and emerge from their slide groove, while simultaneously the loop is tightened again. The wires 16 to 20 begin to swing back in the direction of arrow B. This position of the eye needles is the forward reversing point.

Figure 1A:
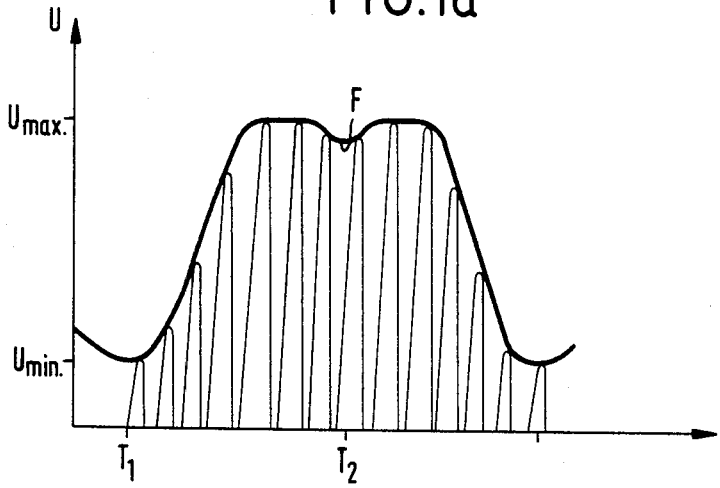

According to FIG. 2 the guide bars and/or eye needles are in their rear position. The overlap is carried out. The loop is loosened. The slides pass into the slide needle groove through the stitch loops. In FIG. 3 the eye needles 6 and 7 with the yarns 1 and 2 are in the beam path 22. For the sake of simplicity, only two eye needles are shown. Since in reality the entire number of the eye needles is in the beam path, it is almost completely masked or interrupted. The signal pulse sequence or infrared signal sequence arising out of the oscillations of the eye needles 6 to 10 can be seen from FIG. 1*a* and FIG. 9 (pulse curve A1).

The infrared signal sequence frequency is large as against the masking and release frequency of the beam.

FIG. 4 shows the forward swinging eye needles (240° position) with the beam path or beam 22 released. This is the position of the knitting elements as in FIG. 1. A yarn marked 30 is not grasped by the eye needles and is located in the beam path of the beam 22. 31 shows capillary breaks or slubs of a yarn 2 or a neighbouring yarn. When the eye needles swing from the rear position into the forward position shown, a loose or broken yarn or a capillary break or a slub follows with delay due to the inertia effect with the result that when the beam path is released by the properly tucked yarns, damaged yarns or yarn parts are still in the beam path, as is clearly seen in FIGS. 1*a* and 9 at the point marked F. The yarn break which is wrought in as in FIG. 4 and which has slipped out of the eye needle is loosely worked in before the knitting tools. In this way the loose yarn forms a loop behind the knitting tools during the back and forth swing of the guide bar or eye needle.

FIG. 3*a* shows at 22*a* a further possible position or arrangement of the infrared beam path. The masking and release of the beam is achieved by the slide needles and yarns. Release and masking are effected at other phase angles.

In the circuit of FIG. 5, a light diode symbolically designated 32 is used as the beam source. The beam coming from the aperture 33 passes to the beam receiver 24 and thus to a receiver diode 34. The receiver signal is amplified in an amplifier 35 and is supplied via a control loop 36 to an infrared transmission circuit 37, which is connected to the transmission diode 32 via the control line 38. An oscillator for the infrared transmission diode is marked 39.

From amplifier 35 a control connection 40 leads to a pulse detector and memory circuit 41, which is also described as a fast rectifier circuit or pulse detector circuit. From stage 41, designated as pulse detector circuit or as timed memory circuit, a control line leads to a comparator stage 42 which switches on and off a warp loom drive circuit 42. The sensitivity of the comparator circuit is adjustable by a sensitivity adjuster 44. Using the latter the reference level for comparator 42 is preset to some extent. 45 designates an electronic gating and/or window circuit which is triggered in synchronism with the infrared receiver signals rectified in the peak or pulse detector circuit and is respectively switched on within the release phase of the beam within a certain time period. From the gating or window circuit 45, periodically release signals are sent in synchronism with the release frequency of the beam via a control line 46 to the comparator 42. The pulse sequence during the respective gating or window phases is indicated and monitored by a display device 47. This device 47 makes possible the gating indications according to position and timing.

In the embodiment of FIG. *5a*, the parts corresponding to those of FIG. 5 have the same reference numerals, but to differentiate them they have been given indices. In contrast to the circuit of FIG. 5, between the comparator 42' and a warp loom drive circuit 43, there is provided a counter 48, which has a preset count time as well as a preset count content. This means that when in the preset time a preset number of pulses is counted at the output of this counter, a control signal appears which is transferred to the machine drive circuit to initiate the circuit of the warp loom.

FIG. 6 shows more details of the pulse detector and memory circuit according to FIG. 5.

A1 indicates an input contact which leads to a first amplifier 49.

At the output of amplifier 49 there is a peak value memory capacitor 50, to which a controllable semiconductor device 51 is connected in parallel. The control electrode of this semiconductor device is connected to the output of a NAND gate 52. A first input of this gate 52 is connected with the output of a monostable multivibrator 53, having a control connection to a comparator 54. This comparator 54 produces cleanly formed rectangular pulses in time with the infrared receiver signals. The pulse phases of these pulses are equal to the mask phases of the infrared beam 22 through the eye needles 6 to 10.

From the peak value memory capacitor 50, a connection leads to a further amplifier 55, whose output is recoupled on the one hand to amplifier 49 and on the other hand to a controllable semiconductor stage 56. This controllable semiconductor stage 56 is in the signal flow current circuit of the infrared control signal and connects the amplifier 55 with a second memory capacitor 57, which is connected to a high ohm impedance converter 58. The output contact of this peak value memory circuit is shown as 59.

The modus operandi of this peak value memory or detector circuit is shown by the pulse sequences in FIG. 7. A1 shows the pulse sequence at this contact point, while the first two pulses represent two complete beam path release phases. The pulse sequence between the two voltage pulses shows the respective masking or beam path interruption phase. The third receiver pulse is smaller than the two preceding pulses. The reason is that the beam has been weakened by a broken yarn and/or by slub formation as seen in FIG. 4.

The pulse sequence A2 shows the pulse sequence at point A2 according to FIG. 6, where this pulse sequence is the result of a pulse conversion. Phase and pulse pause are both identical with the corresponding phases of the pulse sequence A1.

With the falling slope of each pulse A2, the monostable multivibrator 53 is pulsed, whose relaxation time equals $T_M$. This time $T_M$ is smaller by a preset time period than the pulse interval T between two pulses A2. Upon relaxation of the monostable multivibrator 53 after the time $T_M$ to the voltage value 0, the two inputs of the NAND circuit 52 have the voltage value 0 until the moment of the pulse rise of the next pulse of the pulse sequence A2. Consequently, for this brief time the potential "1" is present at the output of the NAND circuit 52. This pulse sequence can be seen on the pulse line A4 in FIG. 6. The pulses of the pulse sequence A4 control periodically the controllable semiconductor 51, which is hard driven during the pulse phases. In the hard driven phases the memory capacitor suddenly discharges as shown in the pulse diagram A5 in FIG. 7. After the lapse of the switch time $T_S$, the memory capacitor 50 is recharged to the peak value. Thus, in the charging phase the voltage at capacitor 50 follows the curve according to pulse sequence A1. On the third charge the peak value is lower than on the preceding charges, since due to the weakening of the beam path or beam, the reception signal is lower. Consequently, the stored peak value as in A5 is correspondingly smaller.

The output of the monostable multivibrator now also controls the controllable semiconductor switch 56, which is hard driven during the relaxation time $T_M$ and is locked during the subsequent pulse pause $T_P$.

Thereafter, the peak voltage stored in the capacitor 50 during the relaxation time $T_M$ is transferred to the capacitor 57. In this time, therefore, the signal flow is switched through. In the time $T_P$ the controllable semiconductor switch 56 is locked, so that the peak value voltage of the capacitor 57 cannot be reduced. The level reductions during the erasure and charging times of capacitor 50 are therefore not transferred to capacitor 57. The result is a d.c. voltage curve A6 as in FIG. 7. This curve A6 at the contact point A6 according to FIG. 6 will only be altered if the respective peak value of a receiver pulse is reduced, as is the case with the third receiver pulse according to A1 in FIG. 7. This d.c. level reduction as in A6 is transferred to the output 59 of circuit 41 and thus leads in the control circuit of FIG. 5 to switching off the drive of the warp loom. In the circuit as in FIG. *5a*, the switch off of the drive of the warp machine is only effected when, within the preset count time, a preset number of such error signals has been found. When using the peak value memory circuit as in FIG. 6, this means that during the preset time of the counter and owing to the reduced d.c. voltage, a preset number of gatings is counted with this reduced voltage.

The relaxation time of the monostable multivibrator 53 is for example 33 microseconds at a pulse frequency of 32 kHz. At a pulse frequency of 10 kHz, the relaxation or reaction time is 10 microseconds.

FIG. *7a* shows a compressed picture of the beam path release phase timed against the FIG. 7 pulse sequence A6. According to FIG. 7, rectangular steps as in the pulse curve A6 form an envelope for a beam path release phase.

FIG. *6a* reproduces the peak detector memory circuit using operation amplifiers 60, 61, 62. 63 is a monostable multivibrator, whose relaxation time is defined by the capacitor 64 and the resistance 65. The first peak value memory capacitor is marked as 66 and the second as 67. 68 shows a switch in the form of a transistor corresponding to the switch 51 in FIG. 6. Switch 56 in FIG. 6 corresponds to switch 69.

70 is a control transistor whose base is connected with the base of the switch transistor 68. Both bases as well as the time input of the monostable vibrator are triggered by a common timing lead 71. This lead 71 obtains its clock pulses either from the time transmission generator 39 in FIG. 5 or from the amplifier 35.

FIG. 8 shows the gating or window circuit 45 of FIG. 5. 72 is an input contact which is connected to the input of an insensitive comparator 73. From said comparator output A2, a signal connection leads to a so-called ramp generator 74, whose output is connected with a window discriminator or gating circuit 75. From its output a control connection leads to an electronic switch 76. A further connection leads to an insensitive comparator 77, which can be set by an adjuster 78.

From input 72 another signal connection leads via an input stage 79 to the main electrode track of the controllable electronic switch 76. Downstream thereof is a memory capacitor 80, to which in turn a high ohm impedance converter 81 is connected. The output thereof is connected to the control input of comparator 77. Here the set value signal from the comparator adjuster 78 is compared with the actual value signalled. If the set value signal is not attained by the actual value signal, a switch 82 is actuated, effecting the separation of the warp loom drive control 83.

In ramp generator 74, a linearly increasing ramp generator voltage is produced, whose level is a measure of the time between two periodic full maskings by the knitting tools. This voltage is sent to the input of the window discriminator 75 and is compared with two threshold voltage values set by a voltage divider 84. When the first threshold value S1 is exceeded or undershot, on the output side the potential jumps from 0 to 1. When the second threshold value S2 is exceeded or undershot, the potential on the output side jumps from 1 to 0.

The pulse sequences at the contact points A1 to A6 of the circuit as in FIG. 8 can clearly be seen from the pulse diagrams in FIG. 9.

As already stated, the pulse sequence as in A1 of FIG. 9 shows the full masking of the infrared light barrier or of the infrared beam as well as the release of the beam taking place alternately and synchronised with the swing back and forth of the eye needles. Periodic fluctuations occur in the voltge in the infrared receiver between a voltage value Umin and Umax. During the full masking of the light barrier, the level voltage is in the lower range, while on release of the beam it is in the upper voltage range.

On the fourth pulse it can be seen that in the release phase of the beam path, a signal dip F is present at time T2. This signal dip is based on an error in the yarn supply.

In pulse curve A2 the output voltage $U_{KOMP}$ is shown, which appears at the output of the comparator 73. The insensitive comparator 73 is adjusted so that during a preset minimum-to-full masking of the beam, rectangular pulses of the width $T_K$ appear. The pulse heights at the output of the comparator 73 are the same each time.

The pulse curve A3 shows the voltage curve at the output of the ramp generator 74. This generator voltage increases linearly within the pulse pauses of the full masking pulse A2. At the end of the pulse pause times $T_P$, the ramp generator voltage $U_{RG}$ has a value which is equal to or greater than a value $U_{MAX}$. This value is independent of time $T_P$ of the full masking pulse. At the end of the pulse pause time $T_P$, the relevant voltage value of the ramp generator remains constant with the rising slope of the full masking pulse. This constant value remains until the pulse phase of the respective masking pulse has ended. Then the linear characteristic of the subsequent ramp begins again.

Pulse sequence A4 shows the voltage at the output of the window or gating discriminator 75. Using the voltage divider 84 comprising the resistances **84*a*, 84*b*, 84*c*, two threshold values $U_{S1}$ and $U_{S2}$ are set so that when the first threshold value $U_{S1}$ is exceeded, a positive pulse slope, as in pulse slope A5, appears, while when threshold value $U_{S2}$ is exceeded a falling pulse slope appears. This means that the linearly rising ramp voltage, based on the ramp start point $T_R$ at the time $T_{RS1}$, generates a respective gating pulse of width $T_{RS2}-T_{RS1}$. By suitable displacement of the two threshold value voltages, the pulses at the output of the window or gating discriminator 75** are suitably selected according to pulse sequence A5 with respect to the respective start point $T_R$ of the ramp voltage or to the start of the release phase of the beam path. In the pulse diagram A5, the pulse voltage for the gating or release pulse or the window pulse is marked as $U_{FD}$.

The respective pulse phase of this gating pulse or the difference between the time $T_{RS2}$ and $T_{RS1}$ is also marked as $T_X$.

The memory 80 is designed so that (FIG. 8) the pulse sequence as at A6 in FIG. 9 produces a d.c. voltage. During the gating times $T_X$ the electronic circuit 76 is hard driven, so that the input voltage at input 72 and thus the level voltage at the infrared receiver can be fully transferred to the output A6 of the high ohm impedance converter 81. During the pulse pauses of the gating or window pulses the electronic switch 76 is locked, so that the voltage at the end of the respective gating time $T_X$ remains until the beginning of the renewed hard driving of the electronic circuit 76. The interrupted lowered area in the pulse sequence A6 of FIG. 9 corresponds to the lowering phases during full masking of the beam path (pulse sequence A1). At time T2, the error F within the gating phase $T_X$ is signalled. With sensitive machine setting, when such an error F appears the warp loom is at once switched off by closure of the switch 82.

When using an error counter as in FIG. **5*a***, the switch off of the loom only occurs when the error marked F appears within the preset time period during each consecutive gating time $T_X$. This would mean that the count content of this counter is attained within the preset time.

If an insensitive comparator 78 is used, the switch off of the loom only occurs when, within gating time $T_X$, the comparative level is not attained. This is the case at time T3. The broken curve shows that the original maximum voltage is not achieved. Then the voltage at the output A6 is reduced in the gating time T to the value indicated. This lowered value is stored in the subsequent locked time or pause phase of the gating pulse.

What is claimed is:

1. Device for the photoelectric monitoring of a wrap loom for irregularities in the yarn supply of a yarn sheet, comprising: an infrared radiation source for producing a beam passing to the eye needles in a plane parallel to said yarn sheet in the area of the yarn supply; an infrared radiation receiver for generating a signal depending on the intensity of said beam; evaluation circuit means for processing said signal; and a display means for responding to a control signal characterising irregularity of said yarn supply and/or a switch device for driving said warp machine, wherein the infrared source and the associated receiver are arranged so that said beam is alternately at least partially interrupted and released in synchronism with the frequency of knitting tool and/or guide bar oscillation by means of the knitting tools and the yarns processed thereby in the reversing positions of said knitting tools, and wherein a periodic monitoring signal sequence thus generated by the infrared receiver is periodically processed in said evaluation circuit by a window or gating circuit means only during a preset gating time period within each beam release phase, so that only the signal values produced in each window pulse gating phase are compared in a comparator means with a comparison value.

2. Device according to claim 1, wherein the infrared beam is arranged for periodic interruption by the eye needles as well as by the yarns passing through them.

3. Device according to claim 1, wherein the infrared beam is arranged for periodic interruption by the slide needles and by the yarns processed thereby.

4. Device according to claim 1, wherein memory means timed by the window or gating circuit means is provided, in which the signal values, in synchronism with the window gating pulse of the signals of the signal sequence, are respectively stored at the end of the window gating phase for the duration of the window gating interval.

5. Device according to claim 4, wherein the stored signal value of the signal sequence is an instantaneous signal value present at the end of each gating phase of the signal sequence.

6. Device according to claim 4, wherein the stored signal value of the signal sequence is a peak value produced during the gating phase of the signal sequence.

7. Device according to claim 4, wherein the stored signal value of the signal sequence is an averaged value produced during the gating phase of the signal sequence.

8. Device according to claim 1, wherein the memory means is a component part of the comparator circuit.

9. Device according to claim 1, wherein the memory means is disposed between the window or gating circuit means and said comparator means.

10. Device according to claim 1, wherein a clocked memory circuit means is provided which has a peak value detector stage which is alternately erased and loaded in synchronism with the clock pulses derived from the infrared receiver signals, wherein the clock pulses are respectively timed ahead of the infrared receiver signals and respectively determine the erasure time, and wherein during the pulse phases of the clock pulses as well as during the respective subsequent clock phases at least until the attainment of a peak value, a switch stage located in the signal transmission line is locked, to which a further memory stage is connected.

11. Device according to claim 1, wherein the infrared receiver signals are stored respectively either as analog or digital signals in the memory means or the memory circuit means.

12. Device according to claim 10, wherein the peak value detector stage consists of a capacitor and a semiconductor switch in parallel therewith.

13. Device according to claim 10, wherein the further memory stage consists of a capacitor.

14. Device according to claim 10, wherein a monstable multivibrator is provided which is triggered at the end of each infrared receiver signal, wherein the relaxation time of said monstable multivibrator is adjusted so that it is smaller by a preset time than the period of the infrared receiver signal, wherein this preset time is the pulse phase of the time pulse as well as simultaneously the erasure phase of the detector stage, and wherein clock pulses for the switch stage of the memory stage are derived from the clock pulses for the controllable semiconductor of the peak detector stage as well as from the monostable multivibrator stage.

15. Device according to claim 10, wherein the peak value detector stage is arranged between the infrared receiver and the comparator means.

16. Device according to claim 1, wherein in said comparator means the comparison value thereof is compared, in synchronism with the signals of the infrared receiver signals or of the window or gating pulses, with the signal values of the signal sequence.

17. Device according to claim 1 wherein the comparison of the signal values with the reference value is respectively made in the memory phase of the window or gating signals.

18. Device according to claim 1, wherein between the comparator means and the switch device for the drive of the warp machine and/or the display means, a counter is provided which can be reset by a certain time period or number of error signals and which issues at its output a control pulse for said switch device when within the time period of preset number of error signals or signal deviations from the comparison value have been counted.

19. Device according to claim 1, wherein the window or gating circuit is a component of a gating circuit which is connected with its input to the infrared receiver, wherein a pulse converter stage is provided whose pulse phases correspond to the release phases of the beam, wherein the pulse converter stage has downstream thereof a ramp generator which during the beam release phases generates a linearly increasing voltage, wherein the ramp generator has downstream thereof a threshold value setting stage or window discriminator stage, in which a first and second threshold value are adjusted for the linearly increasing ramp voltage, and wherein the time phase between the two threshold values of the ramp voltage form the pulse phase in each case for the window signals with respect to position and magnitude.

20. Device according to claim 1, wherein the input of the window and gating circuit is connected with the output of the peak value detector stage.

21. Device according to claim 1, wherein the window or gating circuit is connected with a display device, for example a monitor or a diode display, by which the signal sequence is displayed during the gating time.

22. Device according to claim 19, wherein the gating or window circuit is connected with a controllable semiconductor switch in the signal current circuit of the infrared receiver signals, and to said switch a memory device is connected and wherein during the pulse phases of the window pulses the controllable semiconductor switch is controlled for the transmission of signals while the signal flow in the pulse pauses of the window pulse is locked.

23. Device according to claim 22, wherein the memory device is connected to a comparator which is switched on respectively by the window pulse in the pulse phases and wherein the comparator is connected to a desired value input stage.

24. Device according to claim 1, wherein the infrared beam source is arranged and disposed so that the infrared beam is interrupted wholly by the end areas of the eye needles in the gating phase.

25. Device according to claim 1, wherein the infrared beam source is arranged so that its beam is covered, in the rear reversing position of the guide bars, by eye needles and in the front reversing position is released.

26. Device according to claim 1, wherein the clock frequency of the infrared transmission and receiver signals is large compared with the timing frequency of the knitting tools for example $\geqq 10$.

* * * * *